United States Patent [19]

Westhead

[11] 4,327,779

[45] * May 4, 1982

[54] DRYER FELT HAVING A SOFT, BULKY SURFACE

[75] Inventor: William T. Westhead, Waycross, Ga.

[73] Assignee: Scapa Dryers, Inc., Waycross, Ga.

[ * ] Notice: The portion of the term of this patent subsequent to Apr. 14, 1998, has been disclaimed.

[21] Appl. No.: 64,364

[22] Filed: Aug. 7, 1979

Related U.S. Application Data

[63] Continuation-in-part of Ser. No. 932,409, Aug. 9, 1978.

[51] Int. Cl.[3] ..... D03D 25/00

[52] U.S. Cl. ..... 139/383 A; 139/411; 139/426 R; 162/DIG. 1; 57/210

[58] Field of Search ..... 139/383 R, 383 A, 408, 139/409, 410, 411, 412, 413, 414, 420 R, 420 D, 425 R, 426; 162/348, DIG. 1; 428/280; 57/210

[56] References Cited

U.S. PATENT DOCUMENTS

| | | | |
|---|---|---|---|
| 831,108 | 9/1906 | Ryder | 57/210 |
| 1,811,573 | 6/1931 | Bacheldor et al. | 139/425 R |
| 2,098,993 | 11/1937 | Barrell | 139/383 A |
| 2,208,090 | 7/1940 | Whittier | 139/411 |
| 2,332,393 | 10/1943 | Neville | 139/383 A |
| 3,049,153 | 8/1962 | Jones | 139/426 |
| 3,429,354 | 2/1969 | Brooks | 57/210 |
| 3,653,961 | 4/1972 | Lefkowitz | 139/383 A |
| 4,024,895 | 5/1977 | Barron | 139/426 R |
| 4,093,512 | 6/1978 | Fleischer | 139/420 D |

FOREIGN PATENT DOCUMENTS

| | | | |
|---|---|---|---|
| 1009696 | 11/1965 | United Kingdom | 139/383 A |

*Primary Examiner*—Henry Jaudon
*Attorney, Agent, or Firm*—Fleit & Jacobson

[57] ABSTRACT

A dryer felt having a soft, bulky top surface and comprising at least a top surface, which is defined by a plurality of machine direction yarns and a plurality of cross machine direction yarns interwoven according to a desired weave pattern. A preselected number of the yarns of the top surface are encapsulated yarns, the number being chosen to ensure that a major portion of the top surface is soft and bulky. Each of the encapsulated yarns comprises a straight, twistless monofilament core and a close-fitting encapsulating sheath surrounding the full length of the core.

31 Claims, 5 Drawing Figures

DRYER FELT HAVING A SOFT, BULKY SURFACE

RELATED APPLICATIONS

This application is a continuation-in-part of co-pending U.S. Pat. application Ser. No. 932,409, filed Aug. 9, 1978.

FIELD OF THE INVENTION

This invention relates to papermaking fabrics, in general, and to dryer felts having soft, bulky top surfaces, in particular.

BACKGROUND OF THE INVENTION

A conventional dryer felt consists of an endless conveyor belt made from a one-, two-, or three-plane fabric, wherein the various planes can be defined either by different groups of cross machine direction yarns, machine direction yarns or both. During the drying process, the upper plane, or top surface of the felt is in contact with the paper web being processed. Accordingly, it is desirable for the upper plane of the felt to have a smooth and soft surface to avoid undue marking of the finished paper. Various methods have been tried to produce a dryer felt having an upper surface which exhibits the desired smoothness and softness. While a close weave of the upper or top plane produces the desired smoothness, this advantage is offset by the comparatively high resistance of the dryer felt to the passage of water and water vapor therethrough; the material costs of a close weave felt are also quite high.

The use of soft spun yarns to replace the basic cross machine direction or filling yarns of the top plane has been tried. However, it was found that the resulting dryer felt was too unstable. Later, stuffer or center picks were added in an effort to increase the stability of dryer felts using soft yarns in the top plane. Although stability improved, the cost of producing such dryer felts was greatly increased.

Using cross machine direction or filling yarns made from a stiff core filament or fiber surrounded by a plurality of twisted filaments or fibers to replace the filling yarns of the top plane has also been tried. It has been found that, in use, the stiff core filament or fiber tends to protrude through the twisted-filament or fiber wrap and thereby causes paper marking problems.

In co-pending U.S. application Ser. No. 932,409 filed Aug. 9, 1978, of which this application is a continuation-in-part, there is disclosed an improved dryer felt which overcomes many of the short comings of the prior art. As disclosed in the co-pending application, the improved dryer felt has a soft, bulky top surface or face. A plurality of machine direction yarns and a plurality of cross machine direction yarns are interwoven in a binding relationship according to a desired weave pattern to produce the top surface. A preselected number of the yarns of the top surface are encapsulated yarns having a monofilament core encapsulated in a sheath or sleeve made from a material producing a soft, bulky texture. A sufficient number of encapsulated yarns are used to ensure that a major portion of the top surface is soft and bulky.

As disclosed in the co-pending application, the sheath defines a soft bulky outer surface which, when woven into the fabric, acts to prevent shifting or migrating of the encapsulated yarns bound into the fabric by the machine direction yarns. The monofilament core of the encapsulated yarn, may comprise either a monofilament fiber, or a bundle of fibers treated with a suitable resin such as phenolic resin, to act as a monofilament fiber.

Although a fabric made according to the teachings of the co-pending application exhibits improved strength, stability, smoothness, and softness characteristics, it has been found that these characteristics may be further improved by applying the teaching of the present invention.

SUMMARY OF THE INVENTION

In general, the subject invention consists of a dryer felt having a soft, bulky top surface or face. A plurality of machine direction yarns and a plurality of cross machine direction yarns are interwoven according to a desired weave pattern to produce the top surface. A preselected number of the yarns of the top surface are encapsulated yarns having a substantially straight, twistless monofilament core encapsulated in a close-fitting sheath or sleeve made from a material producing a soft, bulky texture. A sufficient number of encapsulated yarns are used to ensure that a major portion of the top surface is soft and bulky.

Each of the encapsulated yarns comprises a straight, twistless monofilament core and an encapsulating sheath surrounding the full length of the core. The monofilament core may comprise either a straight, twistless monofilament fiber, or a bundle of straight, twistless fibers joined together by resin treatment so that the resin-treated bundle acts as a monofilament fiber. The sheat, defines a soft, bulky outer surface which, when woven into the fabric, acts to prevent shifting, or migrating of the encapsulated yarns bound into the fabric by the machine direction yarns. The encapsulsulated yarns reduce undue paper marking while contributing to fabric stability.

In one embodiment of the subject invention, a single-layer dryer felt having a soft, bulky top surface is provided by using encapsulated cross machine direction yarns.

In another embodiment of the subject invention, there is provided a duplex weave dryer felt having a base plane or surface and a top plane or surface. The base plane is defined by a plurality of cross machine direction yarns. The top plane, which is soft and bulky, is defined by a plurality of encapsulated cross machine direction yarns.

In a further embodiment of the subject invention, a triplex weave dryer felt is provided, having a base plane, a top plane and an intermediate plane. The base plane and the intermediate plane are each defined by a plurality of cross machine direction yarns. The top plane, which is soft and bulky, is defined by a plurality of encapsulated cross machine direction yarns.

By using the specific encapsulated yarns to replace the filling yarns in the top plane of both the duplex and triplex weave dryer felts, the problem of paper marking is diminished by the soft, bulky surface of the dryer felts. Other advantages of using the encapsulated yarns to replace the filling yarns are that yarn migration is eliminated, while at the same time fabric stability is greatly increased.

It is, thus, an object of the present invention to provide an economical and stable dryer felt which is not plagued by paper marking problems.

It is another object of the present invention to provide a dryer felt having encapsulated filling yarns to define a soft, bulky top surface.

It is a further object of the present invention to provide a dryer felt having encapsulated machine direction yarns to define a soft, bulky surface.

It is yet another object of the present invention to provide a dryer felt having encapsulated machine direction and cross machine direction yarns to define a soft, bulky top surface.

It is yet a further object of the present invention to provide an economical and stable dryer felt which is not plagued by yarn migration.

Other objects and advantages of this invention will further become apparent hereinafter and in the drawings.

DETAILED DESCRIPTION OF THE DRAWINGS

Figure 1A:
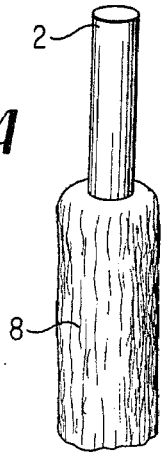
FIGS. 1A and 1B show, in perspective, two embodiments of encapsulated yarns in various stages of assembly.

In describing the preferred embodiments of the invention illustrated in the drawings, specific terminology will be resorted to for the sake of clarity. However, it should be understood that the invention is not to be limited to the specific terms so selected, and it is to be further understood that each specific term includes all technical equivalents which operate in a similar manner to accomplish a similar purpose.

Figure 1B:
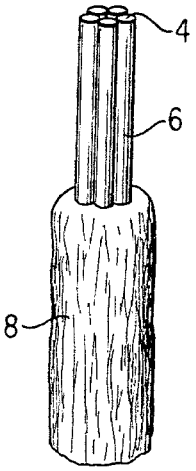

The subject invention will now be described with reference to the figures, in which FIGS. 1A and 1B illustrate two types of encapsulated yarns. At the heart of the encapsulated yarn is a monofilament core designated as 2 in FIG. 1A and 4 in FIG. 1B. The monofilament core 2 is a monofilament of a single fiber whereas the monofilament core 4 is composed of a bundle of synthetic fibers 6, treated with a high temperature resistant resin, such as phenolic resin, to cause the bundle to act as a monofilament fiber in the woven fabric.

The fibers constituting the monofilament cores 2 and 4 are preferably made from polyester. However, the fibers can also be made from polyamides, aramids, acrylics and polyolefins. It is also possible to employ fine wire and/or rubber-type resin treated glass yarns as core materials.

The monofilament core, 2 or 4, is straight and twistless to prevent kinking and to retain maximum resistance to compression without buckling. If the monofilament core exhibits any twist, then it is possible that the core will develop a torque which in turn leads to spiraling and compression of the core. Such spiraling and compression may adversely affect fabric stability. As used herein, the term "twist " is defined, according to industry standards, as the numbers of turns about its axis per unit of length of a yarn or other textile strand. Twist may be expressed as turns per inch (tpi), turns per meter (tpm), or turns per centimeter (tpcm). Thus, a twistless yarn or a yarn with no twist is one that has no turns about its axis per unit of length.

Therefore, the monofilament core 2 comprises a straight, monofilament fiber with no twist, while the monofilament core 4 comprises a bundle of straight monofilament fibers 6 with no twist. Further, the fibers 6 of the core 4 are arranged next to each other throughout their full length, and are not joined together by twisting. The bundle of straight, monofilament fibers 6 without twist are then treated with a high temperature resistant resin, such as phenolic resin, to cause the bundle to act as a monofilament fiber. It should be emphasized, that the fibers 6, constituting the monofilament core 4, are treated to make them act like a monofilament fiber.

Each of the monofilament cores 2 and 4 is encapsulated in a close-fitting sheath or sleeve 8 which completely surrounds and covers the core. Sleeve 8 is made from a material producing a soft, bulky texture. Suitable materials are mineral fibers such as asbestos, natural fibers such as cotton or wool, or synthetic fibers such as polyamides, polyesters, acrylics or aramids. In one embodiment, the sleeve is produced by spun stable fibers in silver, roving or yarn form. In another embodiment, the sleeve is produced by employing a yarn texturising process. In such a process, a yarn comprising a plurality of filaments made from man-made material which are not originally or inherently crinkled are rendered bulky by causing the filaments to become crinkled. The plurality of filaments of the yarn is made up of a group of more than one substantially continuous filament, or a plurality of such groups of filaments. Such yarns are sometimes referred to in the textile arts as "textured" yarns. In yet another embodiment, the sleeve is produced by employing natural yarns which are originally or inherently crinkled, such as cotton or wool, and which are not inherently crinkled, such as bast fibers.

Figure 2:
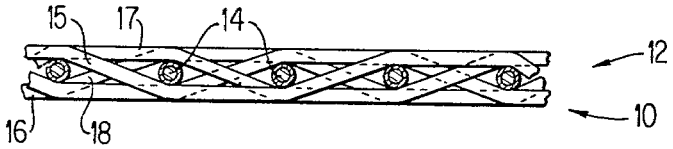
FIG. 2 is a longitudinal section of a single-layer dryer felt employing the subject invention.

One embodiment of the subject invention is illustrated in FIG. 2. A single-layer fabric, generally designated as 10, contains a top plane or surface 12. The top surface, which provides the face of the dryer felt, is defined by a plurality of encapsulated cross machine direction yarns 14, which are made from a synthetic monofilament core encapsulated in a sheath or sleeve made from a material producing a soft, bulky texture, such as a roving of acrylic fiber. The cross machine direction yarns 14 are interwoven with a plurality of machine direction yarns, 15–18, in accordance with a desired weave pattern. The machine direction yarns, 15–18, which are made from a synthetic monofilament, a synthetic multifilament, or spun stable fibers, cross each other sufficiently closely together to bind and hold the encapsulated yarns 14. Further, the soft, bulky outer surface of the encapsulated yarns 14 prevents the encapsulated yarns 14 from shifting, thereby rendering a more stable fabric.

In a fabric produced according to the teachings of the subject invention, the monofilament core, 2 or 4, of the encapsulated yarns 14 must be compatible with the remainder of the yarns in the fabric. During weaving, the encapsulated cross machine direction yarns 14 are woven into the fabric so that they are straight with all crimping taking place in the machine direction yarns 15–18, which are used to bind the encapsulated yarns into the fabric. During subsequent tension and heat setting operations, some of the crimp in the machine direction yarns is transferred to the encapsulated yarns so that the machine direction yarns are less crimped and the encapsulated yarns are moderately crimped.

In order to produce the proper crimp interchange between the machine direction and cross machine direction yarns to give the fabric its proper stability, the diameter of the monofilament core, 2 or 4, of the encapsulated yarn 14 must be the same or greater than the overall diameter of the other yarns forming the fabric. In addition, the materials used to make the monofilament core of the encapsulated yarn should have the same or greater strength and stability characteristics than the other yarns of the fabric.

The diameter of the monofilament core of the encapsulated yarn as well as the overall diameter of the other yarns used to produce the fabric, is important for a different reason. Prior to weaving, the various yarns used to produce the fabric are packaged on rolls. As the yarns sit on the package, they take a cold set and are wavy as they are unwound from the package during weaving. If the core diameter is too big, the wave cannot be controlled at weaving, whereby especially in the case of the encapsulated yarns, it is difficult to produce a straight yarn in the woven fabric. If the core diameter is to small, then fabric stability is lost.

The diameter of the monofilament core 2 and 4 as well as the overall diameter of the synthetic monofilament, the synthetic multifilament, or the spun fiber yarns used for the remaining yarns in the dryer felt, are typically in the range of about 5 to 50 mils, with a range of about 15 to 25 mils being preferred.

Figure 3:
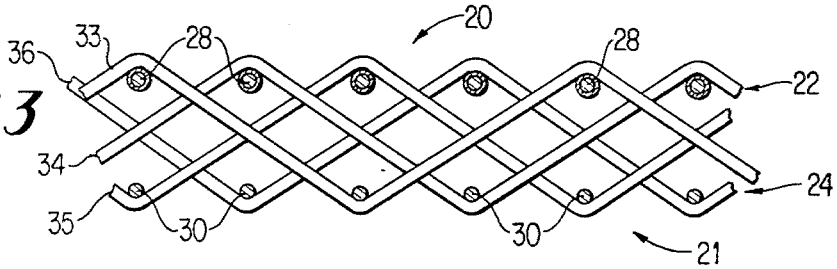
FIG. 3 is a longitudinal section of a duplex weave employing the subject invention.

Another embodiment of the subject invention is illustrated in FIG. 3. A duplex weave, generally designated as 20, contains a top plane or surface 22 and a bottom plane or surface 24. The top plane 22, which provides the face of the dryer felt, is defined by a plurality of encapsulated cross machine direction yarns 28, which are made from a synthetic monofilament core encapsulated in a roving of acrylic fiber. The bottom plane or surface 24, which provides the back of the dryer felt, is defined by a plurality of filling yarns 30, which are made from a synthetic monofilament, a synthetic multifilament or spun staple fibers. The yarn made from the multifilament, or the spun staple fibers is preferably stabilized by a resin treatment using for example phenolic resin; but this is not essential, and it would not be done with every type of dryer felt. The various yarns defining the planes are united in a binding relationship a plurality of machine direction yarns 33 through 36. These yarns are also made from a synthetic monofilament, a synthetic multifilament, or spun staple fibers.

Figure 4:
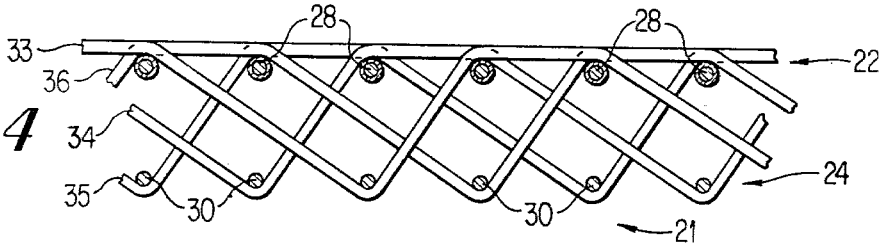
FIG. 4 is a longitudinal section of another duplex weave employing the subject invention.

It is to be understood that other duplex weave dryer felts can benefit greatly from employing the encapsulated yarns of the subject invention. As an example, another duplex weave dryer felt, generally designated as 21, is illustrated in FIG. 4, wherein like numbers denote like elements.

Figure 5:
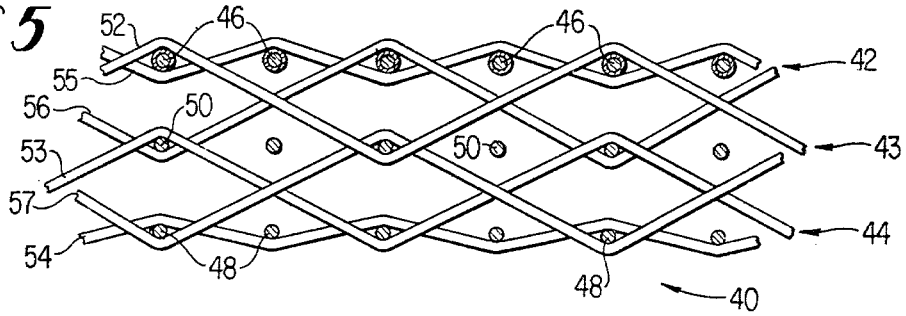
FIG. 5 is a longitudinal section of a triplex weave employing the subject invention.

Yet another embodiment of the subject invention is illustrated in FIG. 5, wherein a triplex weave dryer felt is disclosed. The dryer felt, generally designated as 40, contains a top plane or surface 42, a bottom plane or surface 44, and an intermediate plane 43. The bottom plane 44, which provides the back of the dryer felt, is defined by a plurality of cross machine direction yarns 48, which are made from a synthetic monofilament, a synthetic multifilament or spun staple fibers. The intermediate plane is defined by a plurality of cross machine direction yarns 50, which are also made from a synthetic monofilament, a synthetic multifilament or spun staple fibers. The top plane, which defines the face of the dryer felt, is defined by a plurality of encapsulated cross machine direction filling yarns 46. The yarns used to define the various planes are united in a binding relationship by a plurality of machine direction yarns 52 through 57. These yarns are also made from a synthetic monofilament, a synthetic multifilament or spun staple fibers.

It is also contemplated that encapsulated yarns may be used to provide a dryer felt having a soft, bulky top surface in other ways. Encapsulated yarns may replace some or all of the machine direction yarns, the filling yarns of the top surface being synthetic monofilament or synthetic multifilament yarns which may or may not be encapsulated in a sheath or sleeve made from a material producing a soft, bulky texture.

Obviously, many modification and variations of the present invention are possible in light of the above teachings, and it is contemplated that the encapsulated yarns of the subject invention may not replace all of the top surface filling yarns in the various dryer felt embodiments. It is, therefore, to be understood that within the scope of the appended claims, the invention may be practiced otherwise than as specifically described.

What I claim is:

1. A dryer felt comprising: a top surface; a plurality of machine direction yarns and a plurality of cross machine direction yarns interwoven according to a desired weave pattern to produce said top surface; and a preselected number of said yarns of said top surface being encapsulated yarns, said number being chosen to ensure that a major portion of said top surface is soft and bulky, each of said encapsulated yarns comprising a straight, twistless monofilament core that has no turns about its axis per unit of length, and a sheath completely surrounding and covering the full length of said core, said monofilament core comprising a bundle of filaments treated with a heat resistant resin to make the bundle act like a monofilament.

2. The dryer felt according to claim 1, wherein the preselected yarns of said top surface are machine direction yarns.

3. The dryer felt according to claim 1, wherein the preselected yarns of said top surface are cross machine direction yarns.

4. The dryer felt according to claim 1, further comprising a base plane, and a second plurality of cross machine direction yarns arranged to define said base plane.

5. The dryer felt according to claim 4, further comprising an intermediate plane positioned between said top surface of said base plane, and a third plurality of cross machine direction yarns arranged to define said intermediate plane.

6. The dryer felt ccording to claim 1, wherein said sheath is made from a soft and bulky material.

7. The dryer felt according to claim 6, wherein said sheath is made from a material chosen from the group consisting of asbestos, cotton, wool, synthetic fibers or aramid fibers.

8. The dryer felt according to claim 6, wherein said sheath is made from a material chosen from the group consisting of mineral fibers, natural fibers or man-made fibers.

9. The dryer felt according to claim 1, wherein said monofilament core comprises a monofilament fiber.

10. The dryer felt according to claim 9, wherein said fiber is a wire.

11. The dryer felt according to claim 9, wherein said fiber is made from a treated glass fiber.

12. The dryer felt according to claim 1 wherein said resin is a phenolic resin.

13. The dryer felt according to claim 1, wherein said monofilament core has a diameter in the range of about 5 to 50 mils.

14. The dryer felt according to claim 1, wherein the monofilament core is made from a synthetic material chosen from the group consisting of polyesters, polyamides, aramid, polyolefins and acrylics.

15. The dryer felt according to claim 1, wherein the monofilament core has a diameter in the range of about 15 to 25 mils.

16. The dryer felt according to claim 15, wherein the monofilament core is made from a material chosen from the group consisting of polyesters, polyamides and aramids.

17. The dryer felt according to claim 1, wherein said filaments are twistless so that each filament has no turns about its axis per unit of length.

18. A method of making a dryer felt having a soft, bulky surface, the method comprising the steps of weaving a fabric having a top surface, defining said top surface by a plurality of machine direction yarns and a plurality of cross machine direction yarns, creating a soft, bulky surface on a major portion of said top surface by having encapsulated yarns constitute a preselected number of said yarns of said top surface, and selecting encapsulated yarns, each of which comprises a straight, twistless monofilament core that has no turns about its axis per unit of length and a sheath completely surrounding and covering the full length of said core, said monofilament core comprising a bundle of filaments treated with a heat resistant resin to make the bundle act like a monofilament.

19. The method of claim 18, wherein the preselected yarns of said top surface are machine direction yarns.

20. The method of claim 18, wherein the preselected yarns of said top surface are cross machine direction yarns.

21. The method according to claim 18, wherein the step of selecting encapsulated yarns further comprises selecting an encapsulated yarn comprising a monofilament core made from a synthetic material, and a sheath, made from a soft, bulky material, surrounding said monofilament core.

22. The method according to claim 21, further comprising the step of selecting said synthetic material for said monofilament core from the group consisting of polyesters, polyamides, aramids, polyolefins and acrylics.

23. The method according to claim 21, further comprising the step of selecting said soft, bulky material for said sheath from the group consisting of asbestos, cotton, wool, synthetic fibers, and aramid fibers.

24. The method according to claim 21, further comprising the step of selecting said soft, bulky material for said sheath from the group consisting of mineral fibers, natural fibers and synthetic fibers.

25. A multiple plane dryer felt for processing a paper web, said dryer felt comprising: machine direction and cross machine direction yarns interwoven in a binding relationship according to a predetermined weave pattern to provide a multiple plane fabric including at least a top plane having a paper-contacting surface and a base plane having a machine roll contacting surface, said base plane being defined entirely by a first plurality of said cross machine direction yarns, and said top plane being defined entirely by a second plurality of said cross machine direction yarns, all of said yarns of said first plurality being selected from the group consisting essentially of synthetic monofilaments, multifilaments, and spun staple fibers, and all of said yarns of said second plurality being encapsulated yarns, each of said encapsulated yarns comprising a monofilament core and an encapsulating sheath completely surrounding and covering the full length of said core, said sheath defining a soft, bulky outer surface which, when woven into said fabric, acts to prevent yarn migration of said encapsulated yarns in said fabric and wherein said encapsulated yarns reduce undue marking of said paper web while contributing to fabric stability, said machine direction yarns being interwoven with said first plurality of cross machine direction yarns to define said machine roll contacting surface on said base plane and interwoven with said second plurality of cross machine direction yarns to define said paper-contacting surface on said top plane.

26. The dryer felt according to claim 25, further comprising an intermediate plane positioned between said top plane and said base plane.

27. The dryer felt according to claim 25, wherein said monofilament core comprises a bundle of straight twistless filaments, each of said filaments having no turns about its axis per unit of length and being treated with a heat resistant resin to make the bundle act like a monofilament fiber.

28. The dryer felt according to claim 5, wherein said monofilament core is straight and twistless in that it has no turns about its axis per unit of length.

29. A method of making a multiple plane dryer felt for processing a paper web, said dryer felt having a soft, bulky surface, the method comprising the steps of weaving a plurality of machine direction and cross machine direction yarns according to a preselected weave pattern to form a fabric having a top plane defining a paper-contacting surface and a base plane defining a machine roll contacting surface, said weave pattern chosen so that said base plane is defined entirely by a first plurality of said cross machine direction yarns, and said top plane is defined entirely by a second plurality of said cross machine direction yarns, said weave pattern also chosen so that said machine direction yarns are interwoven with said first plurality of cross machine direction yarns to define said machine roll contacting surface on said base plane and interwoven with said second plurality of cross machine direction yarns to define said paper-contacting surface on said top plane, all of said yarns of said first plurality being selected from the group consisting essentially of synthetic monofilaments, multifilaments and spun staple fibers, and all of said yarns of said second plurality being encapsulated yarns, each of said encapsulated yarns comprising a monofilament core and an encapsulating sheath completely surrounding and covering the full length of said core, said sheath defining a soft, bulky outer surface which, when woven into said fabric, acts to prevent yarn migration of said encapsulated yarns in said fabric and wherein said encapsulated yarns reduce undue marking of said paper web said encapsulated yarns comprising a monofilament core and an encapsulating sheath completely surrounding and covering the full length of said core, said sheath defining a soft, bulky outer surface which, when woven into said fabric, acts to prevent yarn migration of said encapsulated yarns in said fabric, and wherein said encapsulated yarns reduce undue marking of said paper web while contributing to fabric stability.

30. The method of claim 29, further comprising the steps of making said monofilament core from a bundle of straight twistless filaments, each of said filaments having no turns about its axis per unit of length and treating said bundle with a heat reisitant resin to make the bundle act like a monofilament fiber.

31. The method of claim 29, wherein said monofilament core is straight and twistless in that it has no turns about its axis per unit of length.

* * * * *